US005986647A

United States Patent [19]

Feldman

[11] Patent Number: 5,986,647

[45] Date of Patent: Nov. 16, 1999

[54] STING ADDRESSING OF PASSIVE MATRIX DISPLAYS

[76] Inventor: Bernard Feldman, 5 Hangar Way, Watsonville, Calif. 95076

[21] Appl. No.: 08/906,977

[22] Filed: Aug. 6, 1997

Related U.S. Application Data

[60] Provisional application No. 60/023,479, Aug. 6, 1996.

[51] Int. Cl.[6] ..... G09G 3/36

[52] U.S. Cl. ..... 345/204; 345/147; 345/214; 345/215

[58] Field of Search ..... 345/147, 204, 345/214, 215

[56] References Cited

U.S. PATENT DOCUMENTS 3,614,769 10/1971 Coleman ..... 345/42
4,383,254 5/1983 Gemmell et al. .
4,586,039 4/1986 Nonomura et al. .
5,170,443 12/1992 Todd ..... 372/50
5,508,716 4/1996 Prince et al. .
5,734,362 3/1998 Eglit ..... 345/89
5,757,343 5/1998 Nagakubo ..... 345/63

*Primary Examiner*—Bipin H. Shalwala
*Assistant Examiner*—Vincent E. Kovalick
*Attorney, Agent, or Firm*—Oblon, Spivak, McClelland, Maier & Neustadt, P.C.

[57] ABSTRACT

An improved technique for driving matrix displays, and in particular, passive matrix displays including row and column configurations of electro-optical display elements (e.g., liquid crystal, LED, plasma, and Electroluminescent). By analyzing illumination information about display elements, a matrix display is more effectively driven. Also, by using the method, the selection ratio in LCD displays is improved.

13 Claims, 9 Drawing Sheets

LOGICAL SWITCH RELATIONSHIP: $R_N = \overline{RT_N}$
$C_N = \overline{CT_N}$ $V_{AB}$ = V = APPLIED VOLTAGE.

$V_{AD}$ = U = VOLTAGE ACROSS UNSELECTED COLUMNS OF SELECTED ROW $V_{DE}$ = W = VOLTAGE ACROSS CORRESPONDING UNSELECTED COLUMNS OF UNSELECTED ROWS.

$V_{EB}$ = X = VOLTAGE ACROSS CORRESPONDING SELECTED COLUMNS OF UNSELECTED ROWS,

LOGICAL SWITCH RELATIONSHIP: $R_N = \overline{RT_N}$
$C_N = \overline{CT_N}$

STING ADDRESSING OF PASSIVE MATRIX DISPLAYS

CROSS-REFERENCE TO CO-PENDING APPLICATIONS

The present application is based on provisional application Ser. No. 60/023,479, filed Aug. 6, 1996, the contents of which are incorporated herein by reference.

BACKGROUND OF THE INVENTION

1. Field of the Invention:

The present invention relates to an improved technique for driving matrix displays, and in particular, passive matrix displays including row and column configurations of electro-optical display elements (e.g., liquid crystal, LED, plasma, and Electroluminescent).

2. Discussion of the Background:

Matrix displays are addressed by coincident selection of a pixel (picture element) at the intersection of a given row and column. Multiplexing is the term applied to the time division whereby the pixels are excited or driven. Problems arise when driving large matrix displays (e.g., a TV display). With a large display, if the electro-optical display elements are electrically linear, crosstalk (noise in the form of unwanted excitation of unselected pixels) limits the size of the display. If the display elements are non-linear, such as in displays that use a thin film transistor (TFT) switch at the intersection of every row and column, then there are few matrix driving problems caused by crosstalk. However, distributed TFT devices are expensive, and the cost escalates exponentially with the size of the display.

Various techniques have been devised for extending the size of the matrix of linear display elements it is feasible to drive. A tutorial is found in HANDBOOK OF LIQUID CRYSTAL RESEARCH, Chapter 11, *Addressing of Passive Matrix, RMS Responding Liquid Crystal Displays*, by Terry Scheffer, pp. 445–471; Edited by: Collings and Patel, Oxford University Press, 1997 (hereinafter Scheffer). The contents of the "HANDBOOK OF LIQUID CRYSTAL RESEARCH" are incorporated herein by reference. This tutorial incorporates 40 references.

SUMMARY OF THE INVENTION

It is an object of the present invention to address at least one disadvantage of known systems for driving matrix displays.

It is another object of the present invention to provide a passive matrix driving scheme which has a very high signal-to noise (SN) ratio for driving matrix displays of linear elements for display areas at least as large as a TV which utilize low cost integrated drivers and memory.

It is a further object of the present invention to provide a driving scheme applicable to root-mean-square (RMS) responding passive matrix displays such as STN and TN LCDs.

To achieve the above and other objects, the present invention utilizes principles and techniques whereby a matrix display can be successfully driven, for some display applications, independent of the size of the matrix display. Of course, there are practical limits of equipment, expense, etc., that limit the size of the display, but, for one embodiment of driving a display according to the present invention, the size is not limited by the crosstalk.

The method of matrix addressing is called "STING Addressing" because the principle is similar to that employed to bilk the Bookie in the motion picture "The STING." In that movie a delay was introduced between the finish of the race and the wire transmission of the results to the Bookie. During this delay a bet was placed based on the results of the race. In similar fashion, it is feasible to (1) record the image content of a row, plural rows, frame, or plural frames of data to be presented in a visual display, (2) analyze those aspects that promise to enhance the performance of the display in a high speed digital computer, and (3) modify the delayed action to improve the performance of the display. Even though displays are typically updated in 1/60th of a second, the computer operates in increments of 4-5 nanoseconds. This provides an opportunity to perform intelligent delay (STING) addressing.

BRIEF DESCRIPTION OF THE DRAWINGS

A more complete appreciation of the invention and many of the attendant advantages thereof will become readily apparent to those skilled in the art with reference to the following detailed description, particularly when considered in conjunction with the accompanying drawings, in which.

DESCRIPTION OF THE PREFERRED EMBODIMENTS

Figure 1:
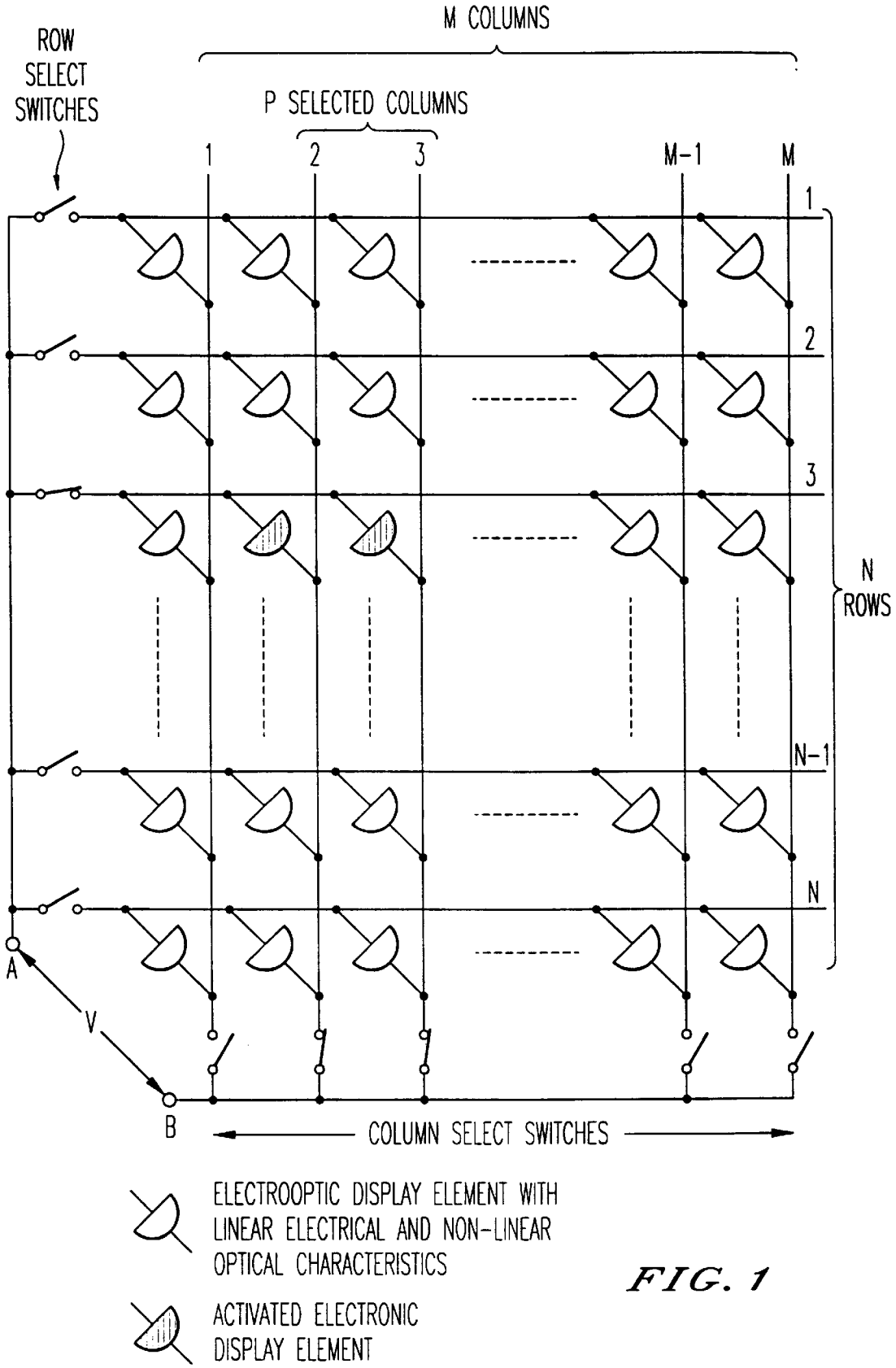
FIG. 1 is a schematic illustration of a matrix of display elements showing an exemplary excitation of one of N rows and two of M columns.

Turning now to the drawings, in which like reference numerals designate identical or corresponding parts throughout the several views, FIG. 1 is a schematic illustration of display elements in an N by M matrix. The present invention includes two principal embodiments. In the first embodiment, a matrix is driven that yields a SN ratio of 3:1 that is independent of the size of the matrix, is inherently AC in nature, requires only the "on" pixel excitation and analyzes one row at a time in a computer to provide the condition for optimum excitation of the display in a delayed (STING) manner. In the second embodiment, a matrix is driven using a root mean square (RMS) responding LCD that involves storing several frames of data, analyzing the properties of the data and utilizing excitation (STING) to improve the overall performance of the display.

Figure 5:
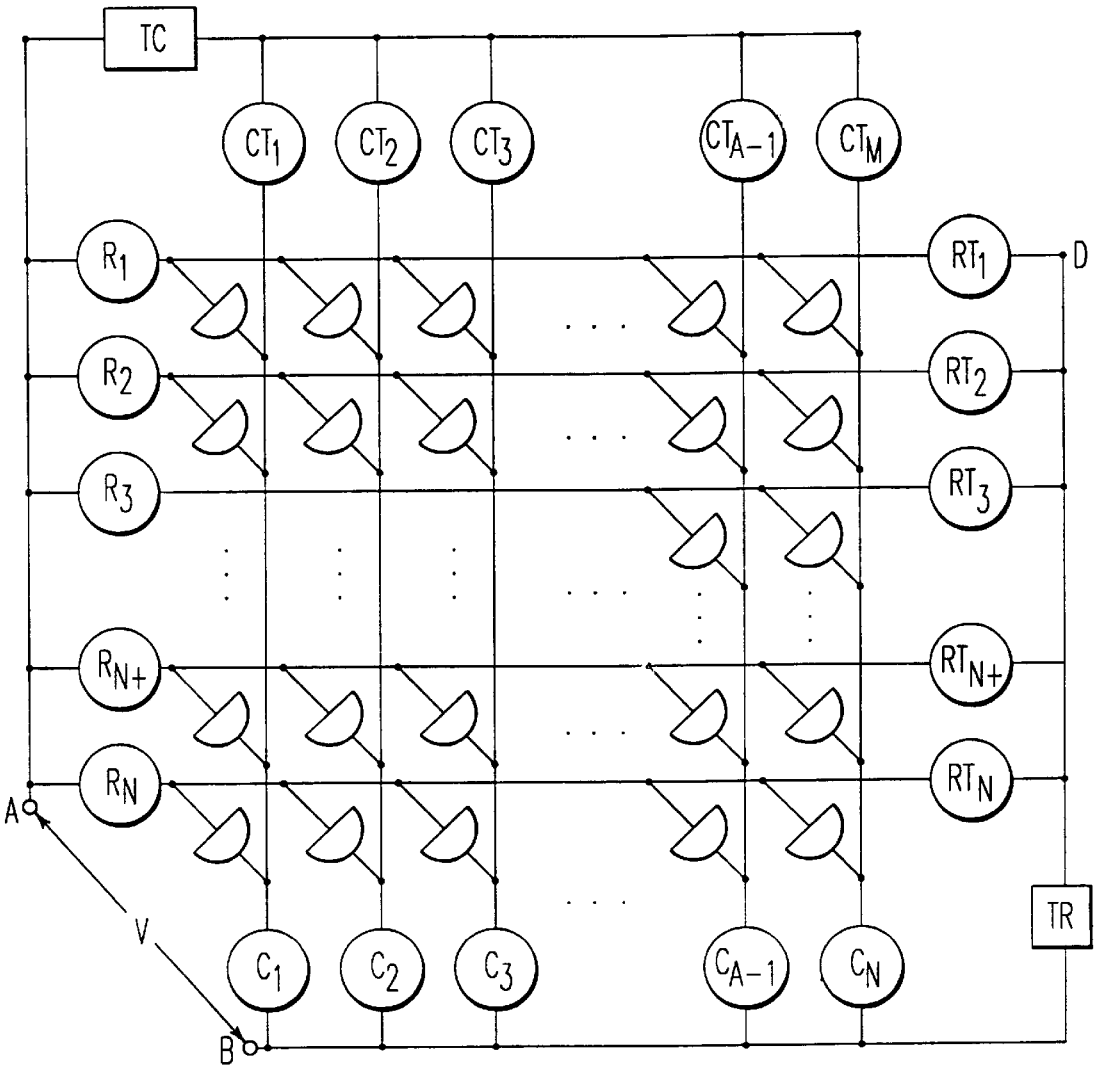
FIG. 5 is a schematic illustration of the driving scheme with appropriate solid state switches for realizing a first embodiment of the present invention.

FIG. 1 depicts the electro-optic display elements as being energized by mechanical switches. This is simply for convenience to specify the crosstalk problem precisely. These switches will be replaced by high speed solid state tri-state switches as shown in FIG. 5. There are N rows of which only one is driven at a time. There are M columns of which $p \leqq M$ are driven simultaneously. Likewise, the display control could be rotated 90 degrees and one column would be driven at a time with multiple rows. The driving voltage, V, needs to be AC for many types of displays to avoid electrolytic decomposition of display materials utilized in display manufacture.

The electro-optic display element is characterized by linear electrical and non-linear optical characteristics. It is assumed, for purposes of this analysis that the impedance, Z, of each element is the same whether it is above or below the threshold for electro-optic response. Although, this is not strictly true, the results still achieve an acceptable SN ratio. For liquid crystal displays (LCDs) the dominating resistive component is unaffected by the optical status of the display. The electro-optical display elements are pictorialized as circles to emphasize that their impedances are independent of their directional connection (linear), thus justifying the analytical transformation of the matrix format of FIG. 1 to the schematic of FIG. 2, a transition which is very important to the comprehension of the essence of this embodiment of the invention.

Figure 2:
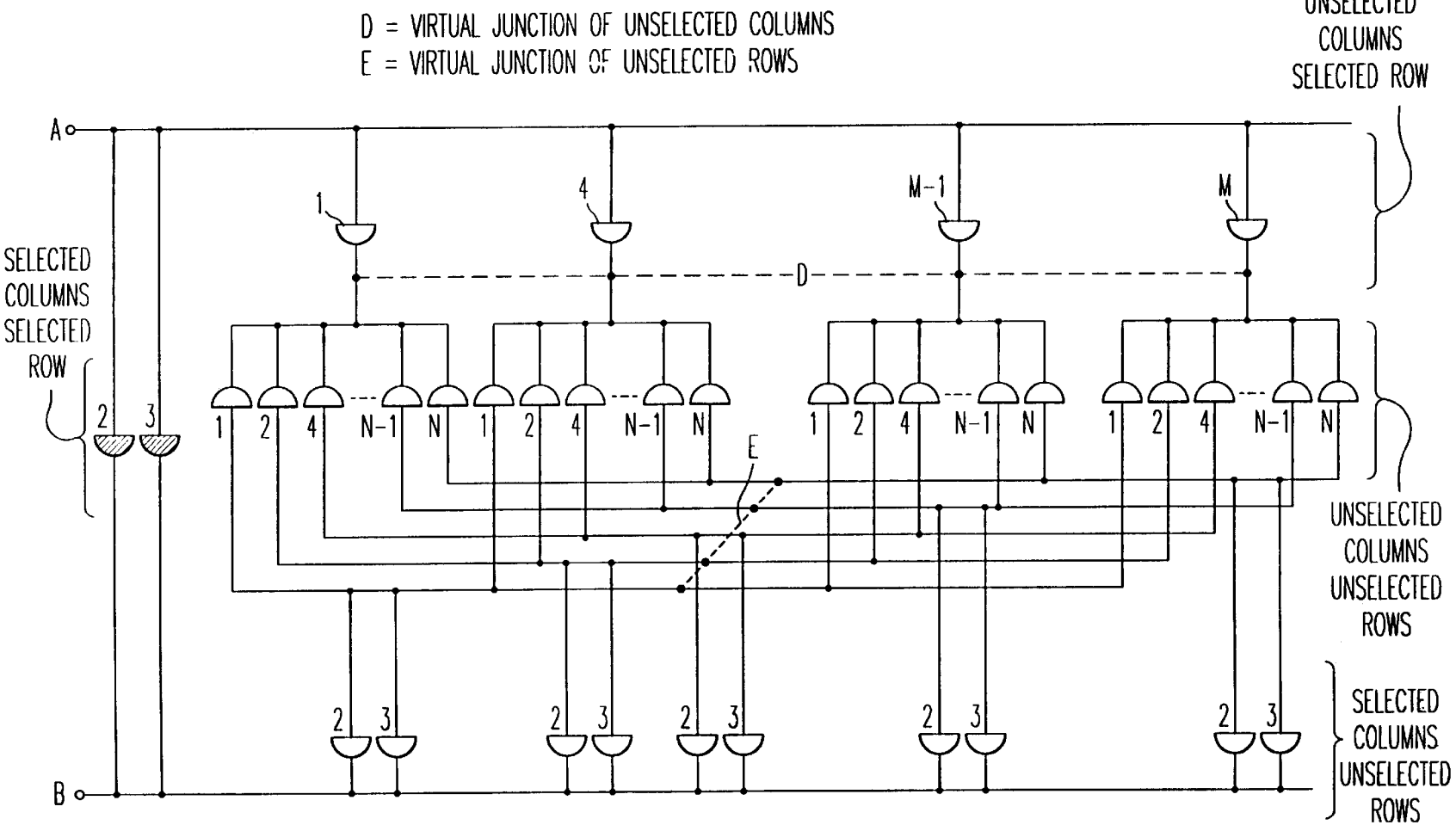
FIG. 2 is a schematic illustration of the matrix of FIG. 1 in a different form to facilitate the description of the crosstalk problem.

If it is assumed that all the elements of the matrix have the same impedances Z, then the rearrangement of the matrix of FIG. 1 into the form as shown in FIG. 2 is valid. Under these circumstances all the selected columns are at the same potential and they are depicted in FIG. 2 as forming the virtual junction labeled D. Similarly all unselected rows are equipotential forming the virtual junction labeled E. It will be shown later that these virtual junctions may be physically joined as practiced in this embodiment of the invention, as shown in FIG. 5 for illustrative purposes only.

Figure 3:
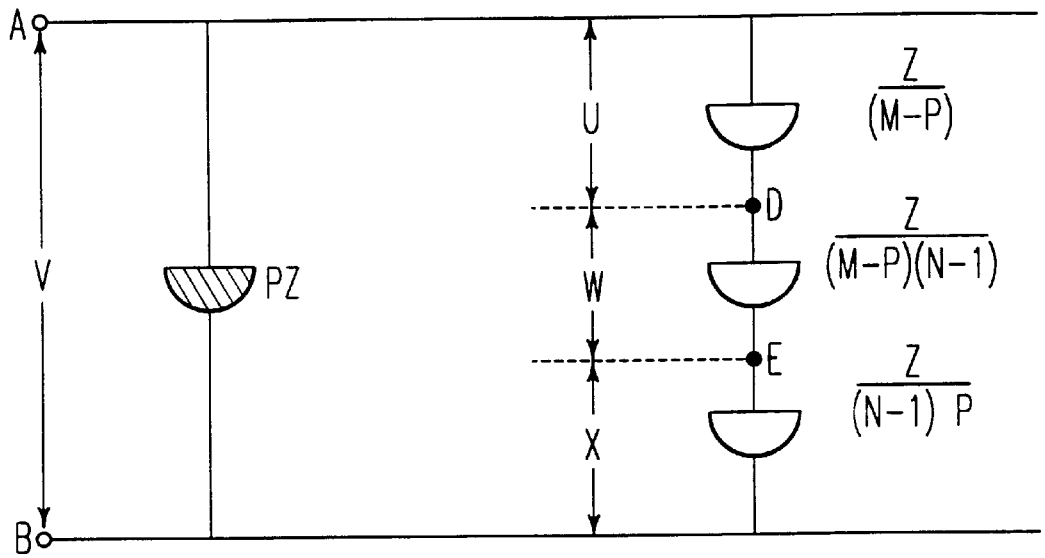
FIG. 3 is a schematic illustration of the simplified and generalized equivalent circuit of a matrix driven a row-at-a-time.

FIG. 3 is a schematic illustration of the simplified and generalized equivalent circuit of the matrix for a given row excitation. In FIG. 3, the relative magnitude of the three crosstalk potentials U, W, X are shown, and what to do about it to optimize the signal-to-noise ratio of a matrix display. Applications like TV do not permit point-at-a-time driving on a practical basis for anything other than a CRT display.

Figure 4:
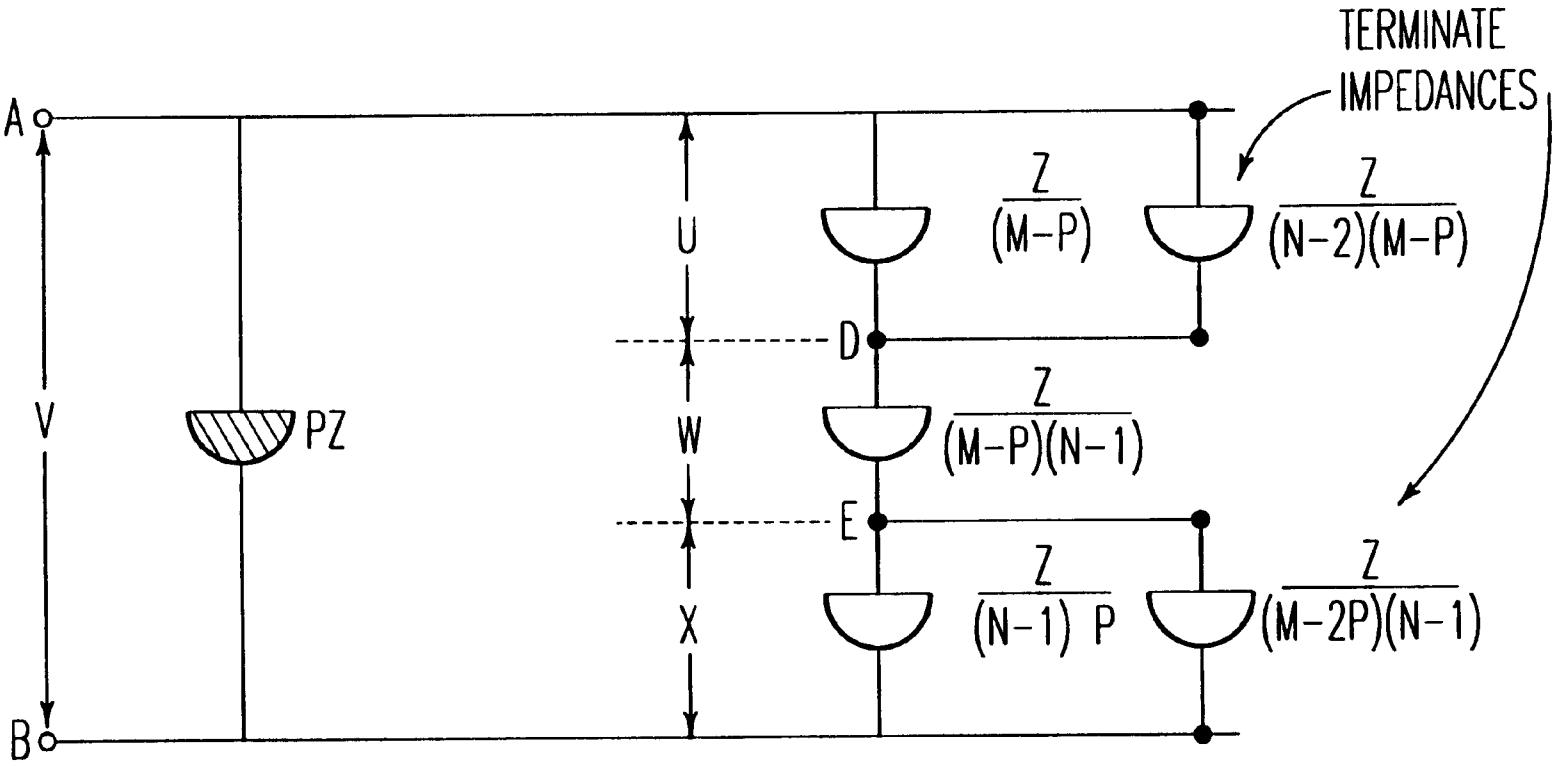
FIG. 4 is a schematic illustration of the circuit of FIG. 3 with terminator impedances such that all crosstalk voltages are equal to one-third of the driving voltage.

As shown in FIG. 4, it is possible to apply terminator impedances of appropriate values to equalize all the crosstalk potentials and thus achieve a SN ratio of 3. The column terminator impedance could be implemented by connecting an impedance equal to Z/(N−2) between A and each column and left floating for selected columns (tri-state switching) and connected to D for unselected columns. However the row terminator impedance value is dependent on the number of columns selected, p, and, moreover, to avoid a negative impedance, p must be limited to M/2 for any given row driven. Therefore these constraints point toward a preference for a single variable impedance terminator for the rows and one for the columns, as illustrated in FIG. 5 by the column terminator, TC and the row terminator, TR.

The terminator impedances TC and TR may be digital assemblies of binary or binary-coded decimal groups of impedances or arrays of display elements or other assemblies devised by those skilled in the art of electronics. Tri-state switches, steered by the appropriate value of p, hook up the correct number of parallel arrays of display elements or impedances to produce the correct and temporal value of terminator impedances for an optimal SN ratio.

One trade-off paid for this optimizing technique is the additional power dissipated in the terminator impedances. In an alternate embodiment, this is mitigated in various ways including not terminating either or both terminators for those cases where the SN ratio is higher than 3:1. For displays that can utilize a 3:1 SN ratio this power penalty is negligible in comparison to the higher voltages utilized in RMS responding LCDs.

Figure 6:
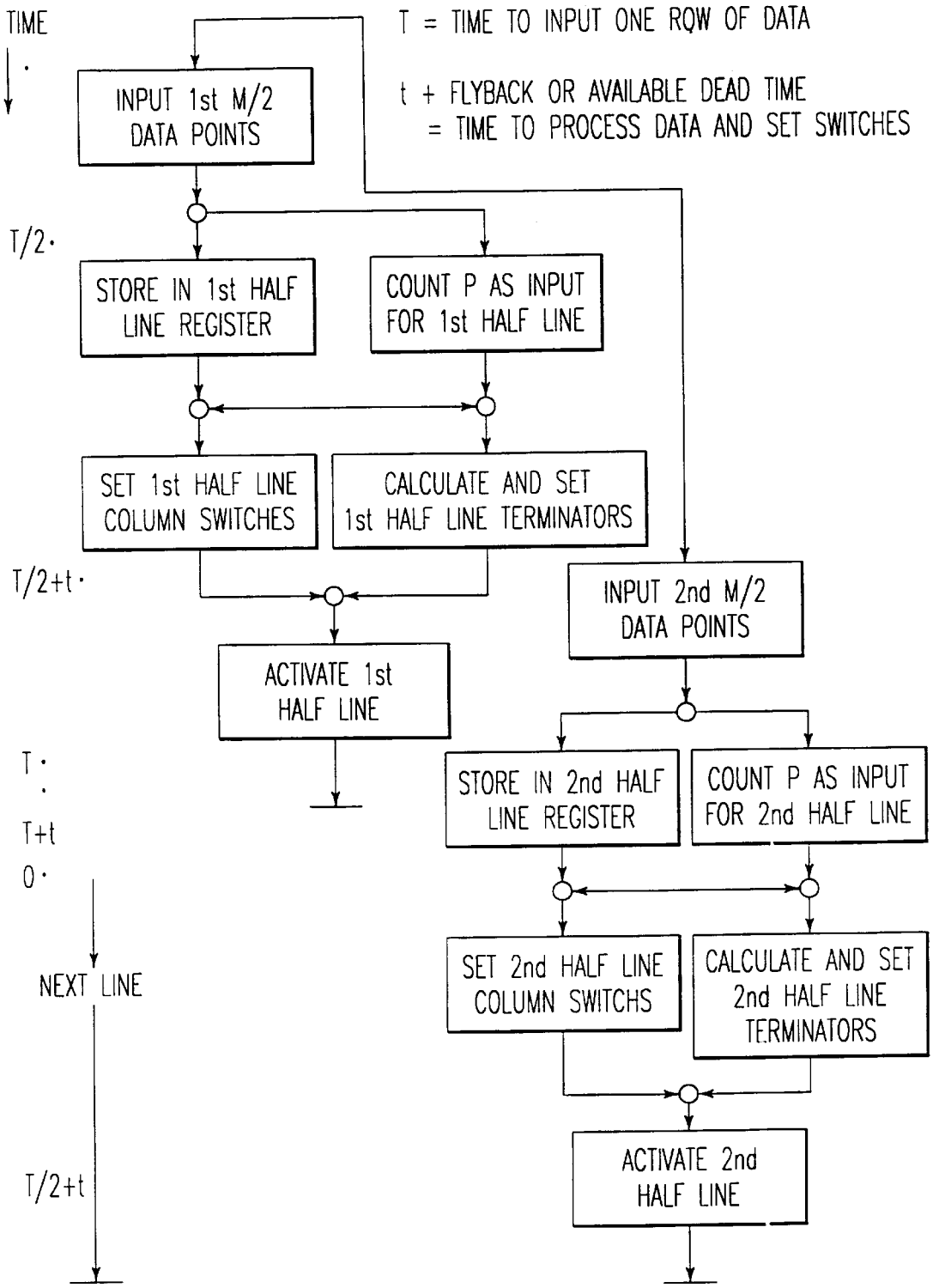
FIG. 6 is a schematic illustration of a flow and time chart of what happens and while processing one row of data into a matrix.

FIG. 6 is a flow-and time-chart of what happens when processing one row of data in the matrix. The main point to note is that if it takes T seconds to input a line of data and there are t seconds of flyback or dead time available between lines, then the requirement on the speed of the semiconductor processing and switching for optimum performance is the time t. If this condition is met then each half line of data is activated for T/2 seconds.

During the first T/2 seconds the first half line is stored in a serial-to-parallel shift register whose individual outputs set the switches $C_1$ to $C_{M/2}$ of FIG. 5. As the data is entered, the number of "true" or active inputs are counted and output to the CPU as the number of columns, p. The CPU also sets the switches $CT_1$ to $CT_M$ based upon the input information: $C_1$ to $C_{M/2}$. After a time T/2 the same process occurs for the second half-line. T seconds of processing time after T/2 seconds, the first half-line is activated for a time of T/2 seconds. The next line of data then is inputted and during a period of time, t/2+t, the second half of the preceding line is activated.

The foregoing example illustrates the STING method of the present invention for driving an electro-optical display a row at a time at high speed. By using data-specific properties of the row and activating the display one row late, the display optimizes the SN ratio. This embodiment is applicable to displays that are especially sensitive to residual DC and its accompanying potential for electrolytic destruction (e.g., as ferroelectric displays, bistable LCDs, electroluminescent, plasma and distributed LEDs).

However, for RMS voltage responding LCDs a simpler drive scheme that utilizes less hardware and achieves higher SN ratios is conventionally employed. It is a DC scheme which employs polarity reversals to achieve an AC effect. The conditions for an RMS voltage responding display are specified in Scheffer.

Figure 7:
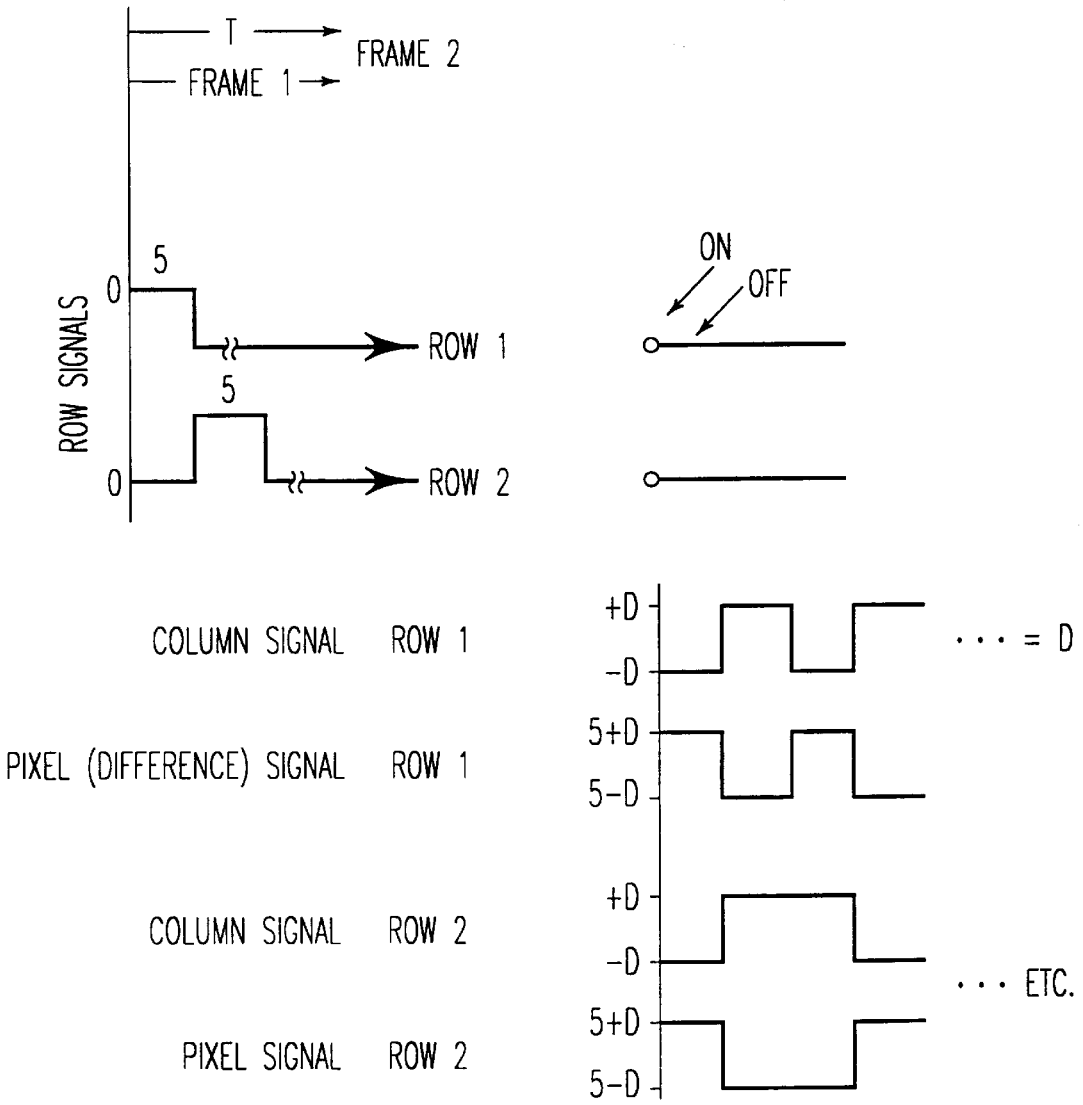
FIG. 7 PRIOR ART
FIG. 7 is a schematic illustration of a conventional selection method for driving passive matrix RMS responding LCDs for all possible permutations of two rows.

Referring to FIG. 7, which is similar to Scheffer's FIG. 11.4 on page 448, note that the selection voltage, S, is applied to one row at a time while all other rows are tied to 0 volts; the columns, either have −D volts for the "on" pixels or +D volts for the "off" pixels. Thus the voltage across a given pixel is the difference between the selection voltage, S, and the column voltage (±D). Thus the voltage applied to all "on" pixels in a selected row is S+D and the voltage applied to all "off" pixels in a selected row is S−D. All pixels in the unselected rows experience ±D. For S=2D we have the case equivalent to the SN ratio of 3:1 shown in the first embodiment of this invention, except for the need to convert this DC drive into AC, which is accomplished by polarity reversal frame-to-frame and other more refined methods described by Scheffer in section 11.2.2 on p. 450 and by Hotto in U.S. Pat. No. 5,627,558, dated May 6, 1997.

Scheffer explains in section 11.2 that S may be optimized at some voltage above 2D, depending on the number of rows in the display or what is equivalent to the selection time of application of the selection voltage. This driving method bears the name of one pair of its discoverers, Alt and Pleshko (A&P) who proved that for LCDs which respond to the RMS of the applied voltage an on-off voltage ratio greater than 3 could be used to advantage. Scheffer also points out that since all rows and columns are at defined low impedance voltage sources, columns are completely independent of each other so he shows only one column in his FIG. 11.4. The same observation can be made about the rows. In the prior art, since the display is addressed in real time, all the column signals for a selected row are presented for that row as that row is selected.

Four columns and two rows are shown in FIG. 7 to emphasize the irrelevance of the column signals for the unselected rows (providing of course that they range between +D and −D) and to foreshadow the opportunity created by STING addressing to address more than one row at a time and selected parts of a given row as described in the following sections. Scheffer describes how the optimized S is determined in section 11.2.1. What follows is a description of STING addressing as it applies to various versions of A&P driven RMS responding LCDs.

STING addressing of RMS responding passive matrix displays involves storing one or more frames of data and addressing the matrix by a delay of the number of frames to be analyzed plus one for the variable CPU time required for the analysis. (The analysis and application time will almost always be less than one frame time but even if more time is required there is no significant consequence.) The example that follows uses a two frame delay to apply the lessons learned from the analysis of only one frame.

Any two rows of unrestricted data can be analyzed in terms of the four possible permutations of the status of the pixels in a single column. Looking at one column, all possible combinations are on-on, on-off, off-on and off-off.

STING addressing may take advantage of the fact that any pair of unrestricted rows may be completely described in three frame time intervals. The waveforms for implementing this embodiment of the invention are shown in FIG. 8. For simplicity only one column of each permutation is shown. All columns of each particular permutation may be extended over three frame time periods and have the appropriate column signal applied wherever in the row pair it occurs.

Figure 8A:
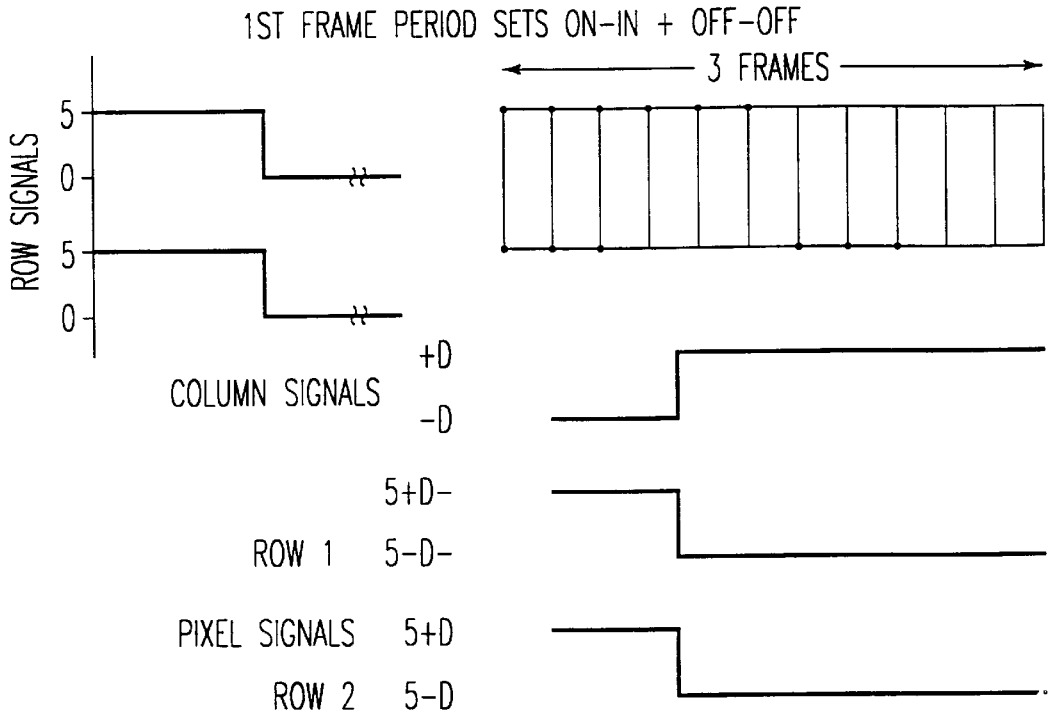
FIGS. 8A to 8C are schematic illustrations of unrestricted row patterns driven 2 rows at a time over three frames using addressing according to the present invention.

STING addressing enables the computer to establish the correct settings for the column voltages for the correct columns to be addressed for the particular row-pair with the corresponding correct selection voltages for that row-pair for the timer period under consideration. As shown in FIG. 8A, during the first normal frame period all on-on pixels in any selected row-pair (they need not be adjacent rows but they might as well be since all rows will receive the identical analysis and addressing) are tagged by the computer controller. The row activation time for addressing the row-pairs, t, needs to be increased by one third over the time for addressing the number of row-pairs in order to provide sufficient time to address all the data in three periods. During the first frame period, for 3t, the controller applies S volts to both of the rows of the selected row-pair, −D volts to the tagged on-on columns, and +D volts to all other columns.

Figure 8B:
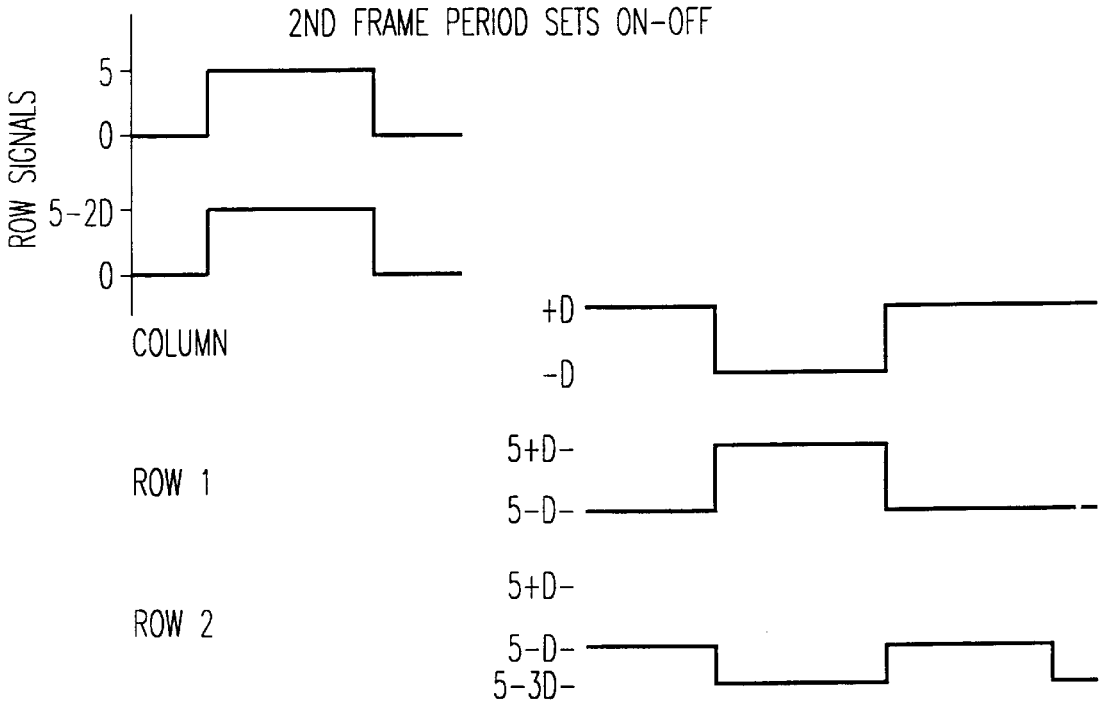

As shown in FIG. 8B, during the second frame periods, all on-off pixels are tagged by the controller, receiving −D volts for those tagged columns. All other columns receive +D volts. The first row of the selected row-pair receives S volts for a 3t period and second row receives S−2D volts for this same period.

Figure 8C:
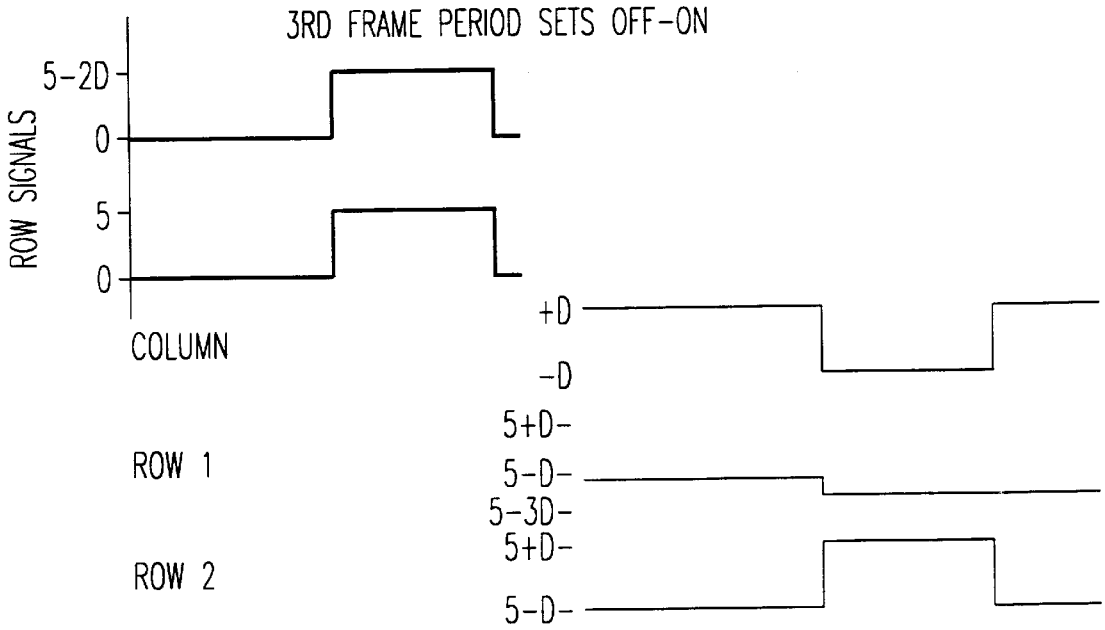

As shown in FIG. 8C, during the third frame period, all off-on pixels are tagged by the controller, receiving −D volts for those tagged columns. All other columns receive +D volts during this period. The first row of the selected row-pair receives S−2D volts during the selection period and the second row receives S volts.

The 120 row-pairs of a 240 row dual scan VGA display would be STING addressed during a time t, applying a selection voltage, S and a data voltage, D that were calculated for an effective 160 row display. As a result the optimized selection ratio for this display would have been improved to 1.0824 from the prior art row-at-a time addressing selection ratio of 1.0667. The tradeoff for this 20% improvement of the tolerance on the LCD material is the slower motion resulting from presenting one out of three successive frames.

This is a form of slow motion which should be acceptable for many applications, and particularly for computer display applications, since there is no flicker associated with the presentation over the three frames that have been treated as one. FIG. 8 shows that for any particular row-pair being addressed the "off" state in a given row is represented by either S−D or S−3D. If the calculations for S and D are determined for the situation where S−D results in a pixel state which is below the threshold, than the fact that S−3D is more off is of no consequence. Utilizing this embodiment could involve speeding up the frame data for some applications and other techniques available to those skilled in the art of addressing passive matrix displays.

An alternative way to employ this ability of STING addressing to drive two rows at a time would be to analyze the data of three successive frames and for those cases where they do not change over three successive frames, drive those frames as row-pairs in similar fashion. This would result in an improved selection ratio for those cases only and would result in a limited increase in the overall selection ratio. So, the preferred embodiment is to present every third frame so that a dual scan VGA display normally requiring the tight tolerances of a 240 row dual scan display can be addressed as 160 line display and the resulting economies implemented. DC bias control and shading control methods, as shown by Scheffer and Hotto are applicable to STING driven displays with the possibility that those skilled in the art may find ways of refining these methods because of the information that is available in the storage register about a display before it is addressed.

Figure 9:
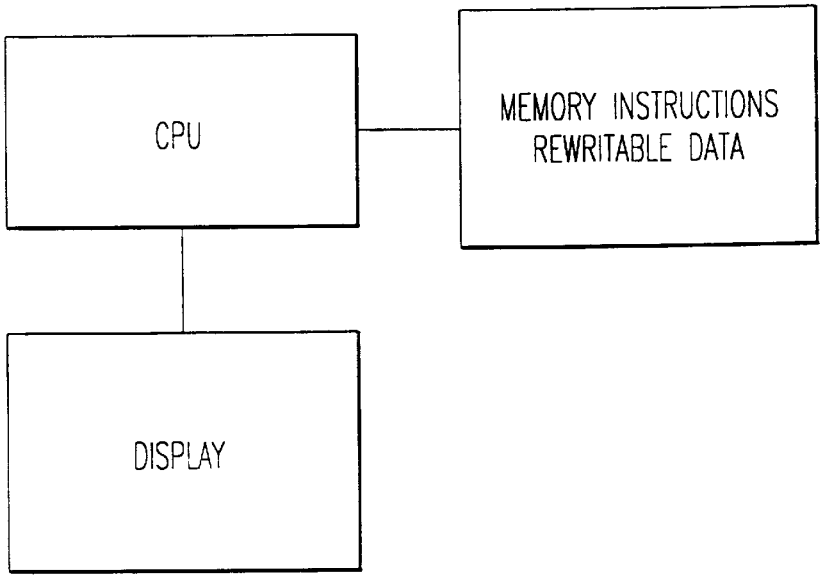
FIG. 9 is a schematic illustration of a controller for driving a matrix display according to the present invention.

FIG. 9 is a schematic illustration of a computer controller according to one embodiment of the present invention. The computer controller includes a central processing unit (CPU) and computer readable storage medium, such as a memory (e.g., ROM, EPROM, EEPROM, Flash memory, static memory, DRAM, SDRAM, and their equivalents), configured to control the CPU to perform the method of the present invention. Likewise, the memory contains rewriteable data for counting/storing the number of"on" elements. The computer controller in an alternate embodiment further includes or exclusively includes a logic device for augmenting or fully implementing the present invention. Such a logic device includes, but is not limited to, an application-specific integrated circuit (ASIC), a field programmable gate array (FPGA), a generic-array of logic (GAL), and their equivalents.

The spirit of this invention extends beyond the examples illustrated for the two principal embodiments. The examples will lead to using STN displays with less critical parameters such as eliminating the need for polished glass and/or permit less expensive TN displays for certain applications. Other applicable properties of STING addressing recognizable by those skilled in the art, should be incorporated into the benefits of STING addressing and covered by the spirit of this invention. The spirit of this invention will lead to other innovations by those skilled in the art that may advance the cause of passive matrix addressing to the point where it will be applicable to desk-top computers at costs that may overcome the cost of replacing the CRT.

What is claimed as new is:

1. A method for addressing a matrix of display elements configured in rows and columns of display elements, the method comprising the step of:

(a) analyzing a number of display elements to be turned on in a first row of display elements;

(b) connecting the first row of display elements to a variable impedance based on the number of display elements to be turned on in the first row; and (c) driving the first row of display elements after the step (b) of connecting.

2. The method as claimed in claim 1, further comprising the step of:

(d) connecting the columns to an impedance equal to Z/(N−2), where Z is an impedance of each of the display elements and N is a number of rows in the matrix; and (e) leaving in a tri-state mode columns corresponding to the display elements to be turned on in the first row.

3. The method as claimed in claim 1, further comprising the step of:

(d) repeating the steps (a)–(c) for a second row of display elements based on the number of display elements to be turned on in the second row.

4. A method for addressing a matrix of display elements configured in rows and columns of display elements, the method comprising the step of:

processing all on-on pixels in a first frame time for a selected row pair, comprising the sub-steps of:

applying S volts to both rows of the selected row pair, applying −D volts to columns corresponding to the on-on pixels, and applying D volts to columns not corresponding to the on-on pixels;

processing all on-off pixels in a second frame time for the selected row pair, comprising the sub-steps of:

applying −D volts to columns corresponding to the on-off pixels, applying D volts to columns not corresponding to the on-off pixels, applying S volts to a first row of the selected row pair, and applying S−2D volts to a second row of the selected row pair; and processing all off-on pixels in a third frame time for the selected row pair, comprising the sub-steps of:

applying −D volts to columns corresponding to the off-on pixels, applying D volts to columns not corresponding to the off-on pixels, applying S−2D volts to the first row of the selected row pair, and applying S volts to the second row of the selected row pair, wherein S is an optimized row selection voltage and D is a column data voltage.

5. A computer readable storage medium configured to control a central processing unit to perform the steps of claim 4.

6. A method of addressing a matrix of display elements configured in rows and columns of display elements, the method comprising the steps of:

(a) storing, in a computer memory, illumination information about display elements of a complete row;

(b) analyzing the illumination information about the display elements in the complete row via a computer; and (c) driving the display elements of the complete row, after the steps (a) and (b) of storing and analyzing, so as to correct defects associated with actual display element data as applied to all of the display elements of the complete row.

7. The method as claimed in claim 6, wherein the step of storing illumination information comprises the step of storing an on or off state for each of the display elements of the complete row.

8. A method of addressing a matrix of display elements configured in rows and columns of display elements, the method comprising the steps of:

(a) storing, in a computer memory, illumination information about display elements in plural rows;

(b) analyzing the illumination information about the display elements in the plural rows via a computer; and (c) driving the display elements in the plural rows, after the steps (a) and (b) of storing and analyzing, so as to correct defects associated with actual display element data as applied to all of the display elements of the plural rows.

9. The method as claimed in claim 8, wherein the step of storing illumination information comprises the step of storing an on or off state for each of the display elements of the plural rows.

10. A method of addressing a matrix of display elements configured in rows and columns of display elements, the method comprising the steps of:

(a) storing, in a computer memory, illumination information about display elements in a complete frame;

(b) analyzing the illumination information about the display elements in the complete frame via a computer; and (c) driving the display elements in the complete frame, after the steps (a) and (b) of storing and analyzing, so as to correct defects associated with actual display element data as applied to all of the display elements of the complete frame.

11. The method as claimed in claim 10, wherein the step of storing illumination information comprises the step of storing an on or off state for each of the display elements of the complete frame.

12. A method of addressing a matrix of display elements configured in rows and columns of display elements, the method comprising the steps of:

(a) storing, in a computer memory, illumination information about display elements in plural frames;

(b) analyzing the illumination information about the display elements in the plural frames via a computer; and (c) driving the display elements in the plural frames, one frame at a time, after the steps (a) and (b) of storing and analyzing, so as to correct defects associated with actual display element data as applied to all of the display elements of the plural frames.

13. The method as claimed in claim 12, wherein the step of storing illumination information comprises the step of storing an on or off state for each of the display elements of the plural frames.

* * * * *